United States Patent [19]

Neyret

[11] 4,153,233

[45] May 8, 1979

[54] VALVE FOR DISPOSABLE GAS LIGHTER

[75] Inventor: Guy Neyret, Francheville, France

[73] Assignee: Etablissements Genoud & Cie, Venissieux, France

[21] Appl. No.: 817,423

[22] Filed: Jul. 20, 1977

Related U.S. Application Data

[62] Division of Ser. No. 611,264, Sep. 8, 1975, Pat. No. 4,072,290.

[30] Foreign Application Priority Data

Sep. 10, 1974 [FR] France ..... 74 31436

[51] Int. Cl.[2] ..... F16K 47/14; F23D 13/04

[52] U.S. Cl. ..... 251/127; 251/353; 251/359; 431/344

[58] Field of Search ..... 431/344; 251/360, 127, 251/353, 359

[56] References Cited

U.S. PATENT DOCUMENTS

| | | | |
|---|---|---|---|
| 2,784,737 | 3/1957 | Kelly | 251/359 X |
| 3,362,680 | 1/1968 | Weiss | 251/360 |
| 3,382,028 | 5/1968 | Yoshinaga | 431/344 X |
| 3,409,049 | 11/1968 | Racek | 431/344 |
| 3,590,591 | 7/1971 | Genoud | 431/344 X |
| 3,961,876 | 6/1976 | Chernock | 431/344 |

*Primary Examiner*—Arnold Rosenthal
*Attorney, Agent, or Firm*—Karl F. Ross

[57] ABSTRACT

A gas lighter has a hollow cylindrical reservoir formed at one end with a smooth cylindrical well at the bottom of which is formed a hole opening into the interior of the reservoir. A rigid plug is force-fitted into the well and has a pair of sides and a passage extending between the sides. One side compresses a block of porous and compressible material which serves to control the flow of gas out of the hole, and the other side of the plug serves as the seat for a valve body reciprocal in the well. The floor of the well and/or the one side of the plug may be formed with a recess so that the plug may bottom in the well with the block in the recess, thereby compressing this block to an exactly predetermined extent so that gas flow and, hence, flame height is determined exactly.

4 Claims, 3 Drawing Figures

VALVE FOR DISPOSABLE GAS LIGHTER

This is a division of application Ser. No. 611,264 filed Sept. 8, 1975, now U.S. Pat. No. 4,072,290 issued Feb. 7, 1978.

FIELD OF THE INVENTION

The present invention relates to a lighter principally for smokers' articles. More particularly this invention relates to a disposable gas lighter.

BACKGROUND OF THE INVENTION

A disposable gas lighter as disclosed in my U.S. Pat. Nos. 3,884,616, and 3,884,618 comprises a cylindrical reservoir body containing liquefied butane. An outlet passage has an inner end opening into the interior of the reservoir and an outer end normally covered by a so-called diffuser formed of a block of porous material. The extent of compression of this diffuser determines the rate at which the gas can vaporize and escape from the reservoir. A valve is provided downstream of this diffuser which, when open, allows the gas to escape at the rate determined by the diffuser. A flint-type sparking device allows the escaping gas to be ignited.

In disposable lighters cost is held to a minimum by presetting during production the flame height as determined by the rate of gas passage through the diffuser. Thus the diffuser, usually composed of a coherent body of nonsoluble fibers, is compressed to a predetermined extent during production. This is effected by often relatively complicated measures so that the saving realized by eliminating the flame adjustment is only nominal, and often the preset flame height is incorrect.

OBJECTS OF THE INVENTION

It is therefore an object of the present invention to provide an improved gas lighter.

Another object is the provision of a disposable gas lighter with a preset flame height that can be produced at very low cost.

SUMMARY OF THE INVENTION

These objects are attained according to the present invention in a lighter of the above-described general type wherein the valve seat is formed by an independent member which is force fitted into the reservoir body and constitutes the member for compressing the pressure-reducing filter or deffuser.

According to a feature of the invention, the pressure-reducing filter is housed in a smooth hole or well in the body of the lighter, into whose base opens the gas-supply channel or passage from the reservoir interior. The valve seat is shaped substantially as a cylindrical cup whose outer face comprises retaining notches and whose outer diameter is dimensioned and shaped to facilitate its introduction and wedging in the aforesaid hole.

Thus to obtain the desired flame height it is sufficient to limit the penetration of the valve seat to the compression value of the pressure-reducing filter corresponding to this flame height.

According to the present invention this simplified valve has a recess or depression for receiving the pressure-reducing filter and having a diameter less than that of the hole in the body of the lighter so that its peripheral edge serves as an abutment limiting the penetration of the valve seat into this hole. This recess may be provided either in the base of said hole or in the lower side of the valve seat.

Finally, according to another feature of the invention, the lower side of the valve seat is formed with a recess in which the pressure-reducing filter is retained with the interposition of a gas-pervious support washer. Thus the valve seat constitutes a subassembly comprising the precalibrated pressure-reducing filter which may be tested before being mounted in the lighter with a combustible gas or any other gas.

BRIEF DESCRIPTION OF THE DRAWING

The above and other objects, features, and advantages of the invention will become more readily apparent from the following description, reference being made to the accompanying drawing in which.

SPECIFIC DESCRIPTION

Figure 1:
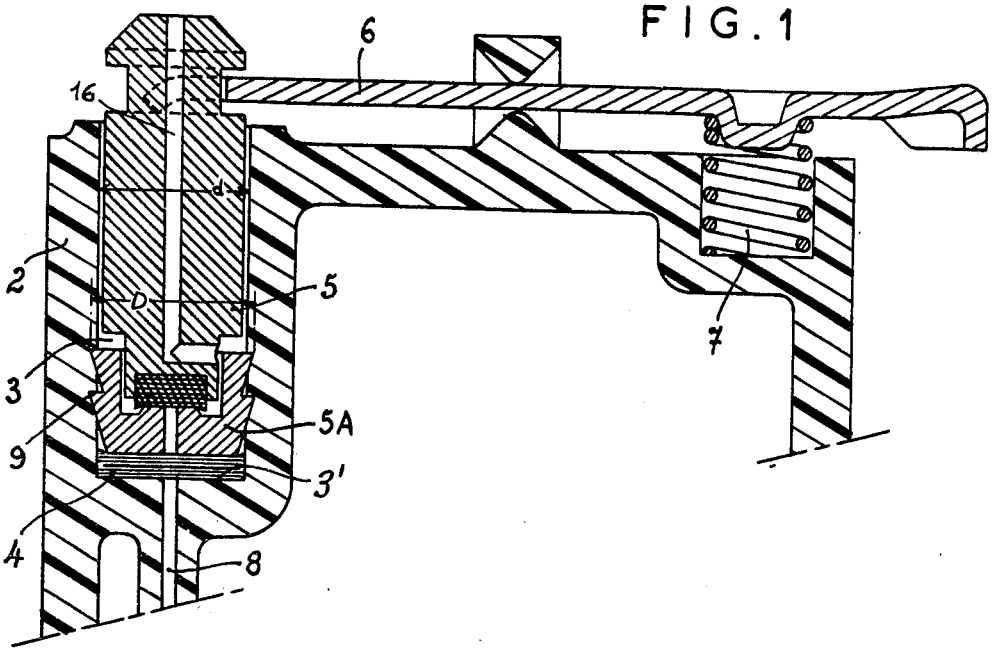
FIG. 1 is a section through the upper part of a lighter equipped with a valve according to this invention.

As seen in FIG. 1 a cigarette, cigar, or pipe lighter has an elongated and cylindrical reservoir 2 formed of a synthetic-resin nonsoluble in butane and formed adjacent one of its ends with an axially descending well 3 whose inner wall is completely smooth and which has a base 3' at which opens a passage leading into the interior of the reservoir body 2. A diffuser filter disk 4 formed of a coherent block of fibers nonsoluble in butane overlies the upper end of the passage 8 and a valve body 5 is vertically reciprocal in the well 3.

This body 5 is carried on an actuation lever 6 biased by a spring 7 downwardly to keep the burner valve in the closed position.

The seat 5A for the burner valve body 5 is an independent member which is fixed by wedging in the hole or well 3 and which also consitutes one of the compression members for the pressure-reducing diffuser filter disk 4.

The diffuser filter disk 4 is necessary in order to limit the height of the lighter flame by limiting the rate of flow out of the reservoir. This limitation is directly dependent on the degree of its compression.

Figure 2:
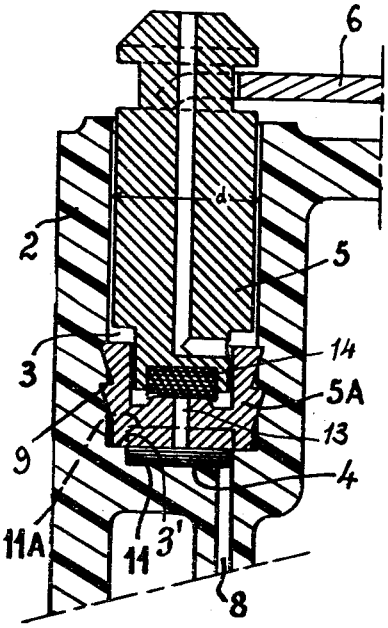
FIGS. 2 and 3 are similar sections through other valves in accordance with the present invention.

In the example illustrated in FIGS. 1 and 2, the seat 5A is in the general shape of a cylindrical cup or plug whose outer cylindrical face is formed as sawtooth ridges 9 ensuring its retention in the hole 3 and whose mean diameter D facilitates its engagement and fixing by wedging in the hole 3 whose diameter d is slightly smaller.

In the example in FIG. 1, compression of the pressure-reducing diffuser filter disk 4 is determined by the penetrating depth of the seat 5A and consequently the means used for this penetration must be previously adjusted to a predetermined value corresponding to the desired height of flame. Carrying out the mounting according to the example of FIG. 1 thus requires very accurate tools.

In the example illustrated in FIG. 2, the bottom of the well 3 is formed with a cylindrical recess 11 whose diameter is less than that of the well 3 and whose depth corresponds to the thickness to which the pressure-reducing diffuser filter disk 4 should be compressed to provide a desired flow of the gas.

In this example, it will be easily understood that it is sufficient for the seat 5A to penetrate until it is in abutment with the peripheral edge of the housing 11 in order that the pressure-reducing diffuser filter disk 4 is compressed to a value corresponding to the desired height of flame.

Instead of or in addition to being provided in the bottom of the hole or well 3, the recess 11 could also have been provided in the lower side of the seat 5A as illustrated in dot-dash lines at 11A in FIG. 2.

Figure 3:
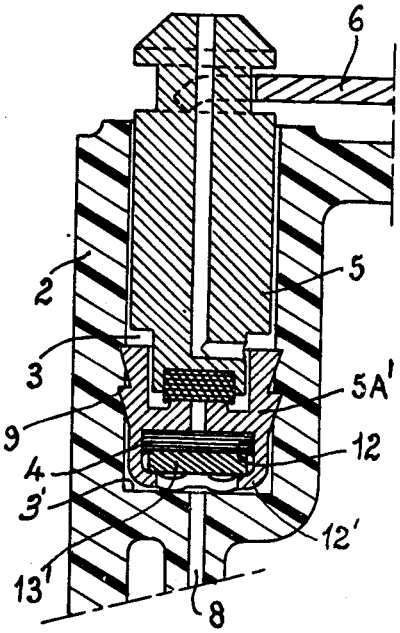

In FIG. 3 the valve seat member or seat plug 5A' is formed at its lower side as a cup 12 whose depth is greater than the thickness of the pressure-reducing diffuser filter disk 4 after compression at the desired pressure in order to facilitate this compression by gripping by undulating edges 12' of the cup 12 with interposition of a support washer formed of a rigid, porous material 13. This embodiment has the advantage that the seat plug 5A' forms an independent subassembly comprising the pressure-reducing diffuser filter disk 4 and able to be tested before it is mounted in the body of the lighter.

As can be seen from FIG. 3, the lever 6 actuates the burner-carrying valve body 5 which is displaceable in the upright well 3 of the housing 2 whose reservoir, below the gas outlet 8, communicates through the latter with the well 3 in the shoulder formed by the bottom of the well. The valve seat member or plug 5A which is force-fittingly received in the well and has outwardly directed ridges 9 engaging the wall of the well, has an upwardly open concavity which receives a boss on the bottom of the valve body 5.

The fuel passes upwardly from the reservoir through the gas outlet 8 and between undulations of the inwardly turned edges 12' of the cup 12, around the support washer and then through the diffuser disk 4 to the passage between the opposite sides of the plug 5A. When the valve body 5 is lifted from the valve seat at the top of this passage, the fuel can flow through the bore of the valve body to the upper burner end thereof. The inwardly turned edges 12' of the top 12 rest against the shoulder formed by the bottom of the well. Furthermore, this arrangement has the same advantages as that illustrated in FIG. 2, since introduction of the seat 5A' into the well 3 takes place until it bottoms at the base of said hole without its being necessary to limit the penetration to a predetermined value.

With the system according to the present invention the body 5A or 5A' constitutes a plug which completely prevents gas flow to the upper portion of the well 3 except through its passage 13. Thus only when the sealing disk 14 carried on the bottom of the valve body 5 is out of engagement with the one end of his passage 13 can gas flow out of the resevoir 2.

It is noted that the ignitor for gas issuing from the top of the passage 16 extending through the valve body 5 is not shown in the drawing. This device is described in my above-cited patents.

I claim:

1. A valve for a lighter having a reservoir for a compressible fluid, comprising:

a housing formed unitarily with an upright well, defined by a cylindrical wall, a gas outlet communicating with said reservoir and opening into said well at the bottom thereof, and a shoulder surrounding said outlet at said bottom of said well, said well having a mouth above said outlet;

a compressible unapertured diffuser filter disk member of porous material in line with said outlet and directly resting upon said shoulder;

a valve seat member press-fittedly received immovably in said well and permanently laterally engaging said wall, said valve seat member having a pair of opposite sides while being formed with a passage extending between said sides, one of said sides bearing against and directly compressing said disk member against said shoulder whereby fluid exiting from said reservoir through said outlet enters said passage well only upon diffusion through said disk member, said valve seat member terminating below said mouth; and a valve body movable relative to said seat member sealingly engageable over said passage at the other side of said seat member.

2. The valve defined in claim 1 wherein said seat member is formed as a plug concave in the direction of said valve body and provided with a central boss at said other side, said body extending into the concavity of said plug and bearing against said boss.

3. The valve defined in claim 1 wherein said plug has outwardly directed ridges engaging the wall of said well.

4. The valve defined in claim 3 wherein said shoulder is formed with a depression, said disk member is received in said depression, said seat member bears against said shoulder and said outlet opens into said depression.

* * * * *